US012628988B2

(12) United States Patent
Zhou

(10) Patent No.: US 12,628,988 B2
(45) Date of Patent: May 19, 2026

(54) QUICK-DETACHABLE AND LOCKABLE INFANT BATH SEAT

(71) Applicant: Guanjing Zhou, Zhejiang (CN)

(72) Inventor: Guanjing Zhou, Zhejiang (CN)

( * ) Notice: Subject to any disclaimer, the term of this patent is extended or adjusted under 35 U.S.C. 154(b) by 0 days.

(21) Appl. No.: 19/311,110

(22) Filed: Aug. 27, 2025

(65) Prior Publication Data

US 2026/0060480 A1 Mar. 5, 2026

(30) Foreign Application Priority Data

Aug. 30, 2024 (CN) ..... 202422121786.4

(51) Int. Cl.
*A47K 3/12* (2006.01)

(52) U.S. Cl.
CPC ..... *A47K 3/122* (2013.01)

(58) Field of Classification Search
CPC ..... A47K 3/122; A47K 3/127
USPC ..... 4/572.1
See application file for complete search history.

(56) References Cited

U.S. PATENT DOCUMENTS 12,226,056 B1 * 2/2025 Chen ..... A47K 3/122

* cited by examiner

*Primary Examiner* — Lauren A Crane
(74) *Attorney, Agent, or Firm* — Hawaii Patent Services; Nathaniel K Fedde; Kenton N. Fedde

(57) ABSTRACT

The present disclosure relates to a quick-detachable and lockable infant bath seat, comprising a seat assembly, with a middle post and a backrest seat connected to the front end and rear end of the seat assembly respectively. An elliptical locking box is mounted at the top of the middle post, and a limiting armrest is rotatably connected to the top of the backrest seat. A temperature sensing meter is snapped onto the top of the elliptical locking box, and accommodating grooves are provided on both left and right ends of the elliptical locking box. Slidable locking blocks are arranged within the accommodating grooves, and the outer end walls of the locking blocks are arc-shaped.

19 Claims, 8 Drawing Sheets

QUICK-DETACHABLE AND LOCKABLE INFANT BATH SEAT

CROSS-REFERENCE TO RELATED APPLICATIONS

This application claims priority to Chinese Utility Model patent application No. 202422121786.4, titled "Quick-Detachable and Lockable Infant Bath Seat," filed on Aug. 30, 2024, the content of which, including the amendments thereof, is are incorporated herein by reference in its entirety.

TECHNICAL FIELD

The present disclosure relates to the technical field of infant bathing equipment, particularly to a quick-detachable and lockable infant bath seat.

BACKGROUND

Infants have delicate skin with a thin stratum corneum. Due to their underdeveloped defense mechanisms, improper care can lead to skin erosion or even bacterial infections. The low water content in the stratum corneum of infant skin makes it prone to dryness. Under the influence of genetic and environmental factors, infants often suffer from eczema, for which bathing and moisturizing are essential management methods.

In the prior art, infant bath seats are mostly bucket-shaped structures, making it inconvenient to clean accumulated water inside. Infants must be lifted in or out of the bucket. Some designs use a base and armrests to form an enclosed bathing space, but the locking mechanism for the armrests often requires simultaneous two-handed operation-one hand to release the lock and the other to rotate the armrest into place-making locking cumbersome. Moreover, the two-handed operation leaves no hand free to hold the infant, increasing the risk of pinching injuries if the infant moves unpredictably.

SUMMARY

The present disclosure provides a quick-detachable and lockable infant bath seat to address the issues raised in the background.

A quick-detachable and lockable infant bath seat comprises a seat assembly, with a middle post and a backrest seat connected to a front end and a rear end of the seat assembly respectively, wherein an elliptical locking box is mounted at a top of the middle post, and a limiting armrest is rotatably connected to a top of the backrest seat; and a temperature sensing meter is snapped onto a top of the elliptical locking box, and accommodating grooves are provided on both left and right ends of the elliptical locking box, wherein a slidable locking block is arranged within each accommodating groove, and the locking block has an arc-shaped outer end wall; and a lock hole is recessed on an outer side wall of a free end of the limiting armrest, and a locking tongue is provided at an inner end of the locking block to be engaged with the lock hole.

A quick-detachable and lockable infant bath seat comprises a seat assembly, wherein a backrest seat is provided at a rear end of the seat assembly, and a middle post is provided at a front section of the seat assembly; an elliptical locking box arranged on the middle post; and a limiting armrest rotatably connected to the backrest seat, wherein a free end of the limiting armrest is configured to be receivable by the elliptical locking box; accommodating grooves formed on both sides of the elliptical locking box, each accommodating groove housing a locking block slidable along a straight line; and a lock hole formed on an outer sidewall of the free end of the limiting armrest, wherein an inner end of the locking block is provided with a locking tongue for engaging with the lock hole to achieve locking; a reset elastic member arranged between the locking block and an inner wall of the accommodating groove, providing the locking block with an elastic force that tends to insert the locking tongue into the lock hole; and an unlocking mechanism arranged on the elliptical locking box and engaging with the locking block, configured to drive the locking block to slide against the elastic force of the reset elastic member, thereby disengaging the locking tongue from the lock hole.

A quick-detachable and lockable infant bath seat comprises a seat assembly provided with a backrest seat and a middle post; a locking seat arranged on the middle post, having an accommodating space inside; a limiting armrest, with one end rotatably connected to the backrest seat, the other end being a free end capable of entering the accommodating space; a locking component arranged within the locking seat, movable along a preset trajectory; a complementary locking structure, comprising a locking part arranged on the locking component and a locked part arranged on the free end of the limiting armrest, wherein the locking part and the locked part can be engaged to achieve locking; a bias device arranged between the locking seat and the locking component, providing the locking component with a bias force that tends to engage the locking part with the locked part; and an unlocking assembly engaged with the locking component, capable of driving the locking component to move against the force of the bias device to disengage the locking part from the locked part to release locking.

To achieve the above inventive objective, the present disclosure adopts the following technical solution:

By setting a targeted horizontally sliding locking block, the limiting armrest can abut against its outer wall when closed, enabling its movement and use. The positioning of the lock hole and locking tongue allows the limiting armrest to lock after moving to the extreme position within the accommodating groove. The overall locking structure is easy to engage, with the default position of the locking block controlled by the reset spring to ensure locking effectiveness. The armrest can also be manually pinched for removal, facilitating bathing operations with simple handling.

BRIEF DESCRIPTION OF DRAWINGS

The drawings, which form part of this application, are intended to provide further understanding of the present disclosure. The illustrative embodiments and descriptions thereof are for explaining the present disclosure and do not constitute undue limitations. In the drawings.

Figure 1:
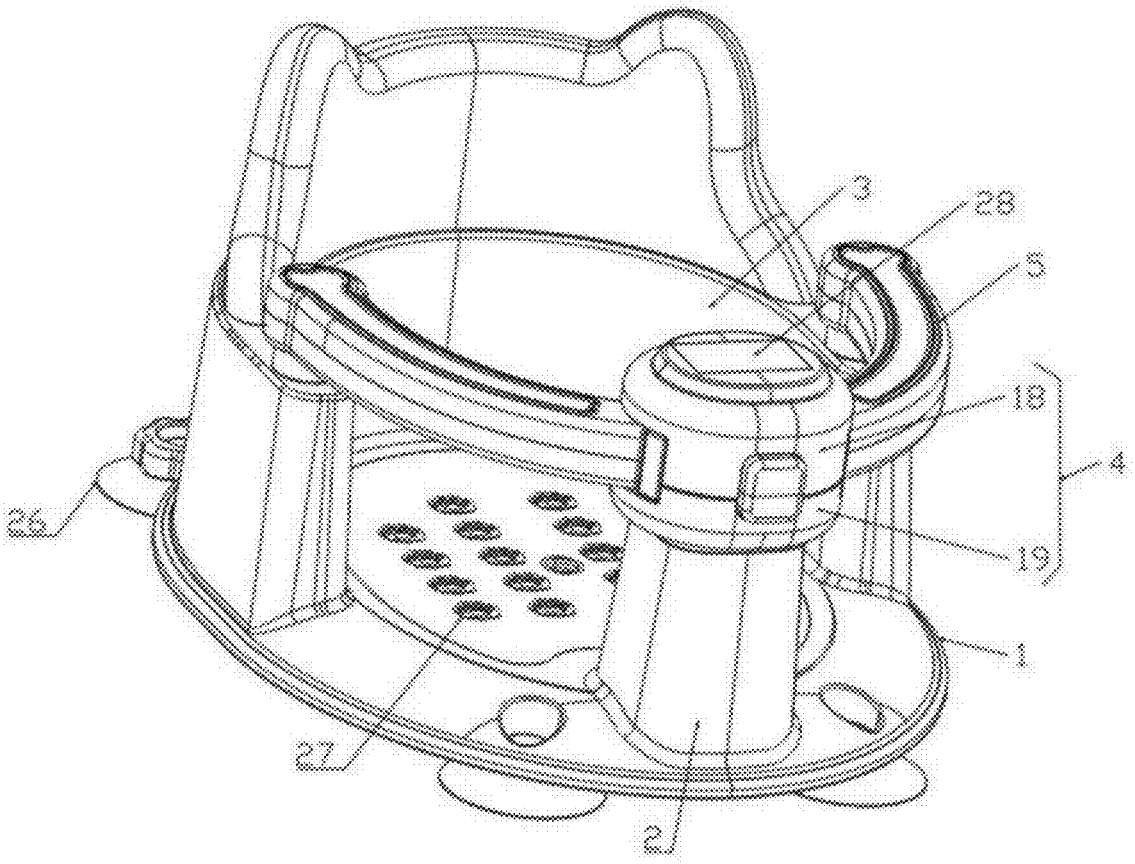
FIG. 1 is a schematic structural diagram of a quick-detachable and lockable infant bath seat.
Figure 2:
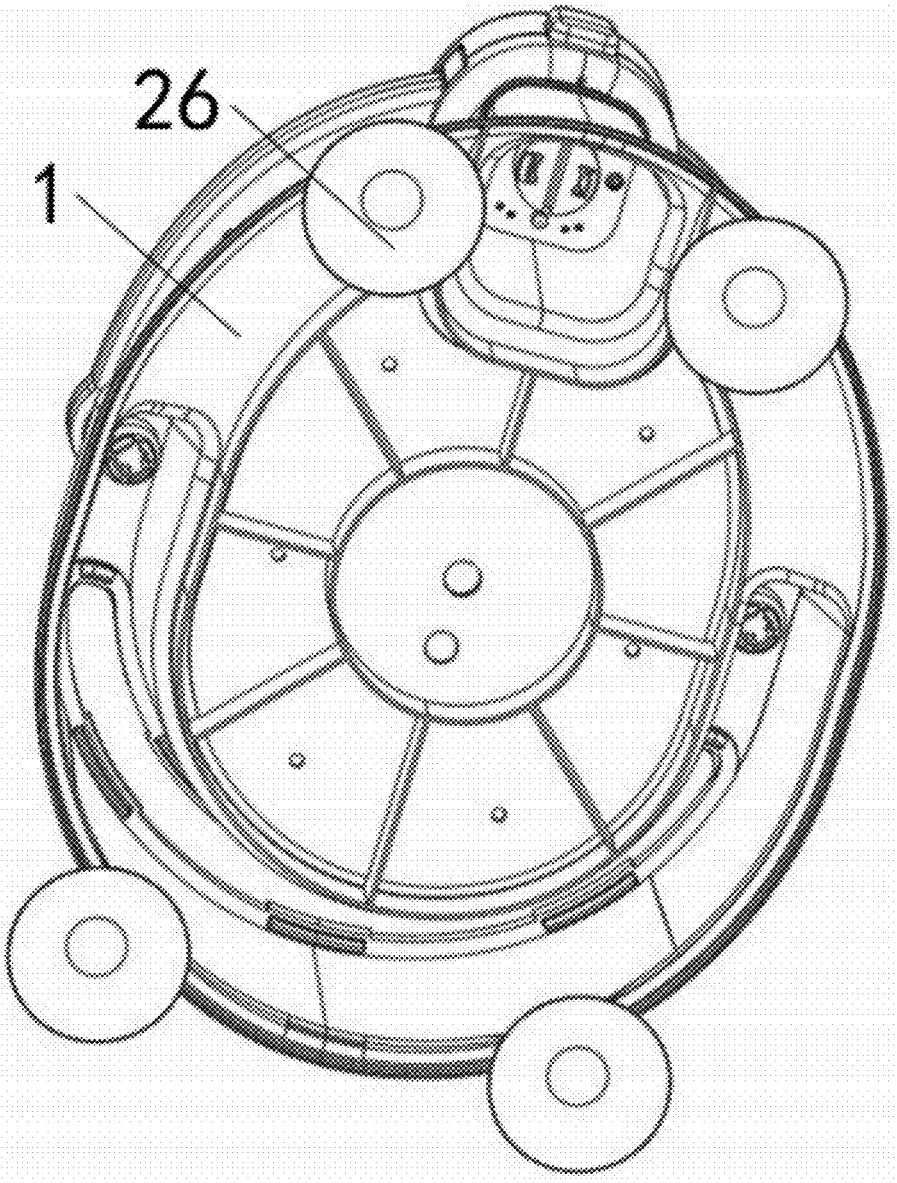
FIG. 2 is a schematic structural diagram of a bottom view of the quick-detachable and lockable infant bath seat.

Reference signs: 1, Seat assembly; 2, Middle post; 3, Backrest seat; 4, Elliptical locking box; 5, Limiting armrest; 6, Accommodating groove; 7, Locking block; 8, Lock hole; 9, Locking tongue; 10, Positioning frame; 11, Positioning port; 12, Positioning tongue; 13, Inclined surface; 14, Spring groove; 15, Center post; 16, Sliding block; 17, Sliding groove; 18, Upper housing; 19, Lower housing; 20, Positioning post; 21, First elastic card; 22, Shaft body; 23, Second elastic card; 24, Groove opening; 25, Bump; 26, Positioning ring; 27, Anti-slip pattern; 28, Temperature sensing meter; 29, Secondary drainage hole; 30, Drainage groove; 31, Limiting block; 32, Limiting groove.

DESCRIPTION OF EMBODIMENTS

The technical solution in the embodiment of the present disclosure will be clearly and completely described below with reference to the drawings. Obviously, the described embodiment is part of, rather than all of the embodiments of the present disclosure. The following description of at least one exemplary embodiment is illustrative in nature and is in no way intended to limit the present disclosure, its application or uses. Based on the embodiments in the present disclosure, all other embodiments obtained by those skilled in the art without creative work belong to the scope of protection of the present disclosure.

It should be noted that the terminology used here is only for describing specific embodiments, and is not intended to limit exemplary embodiments according to the present application. As used herein, the singular form is also intended to include the plural form unless the context clearly indicates otherwise. Furthermore, it should be appreciated that when the terms "comprising" and/or "including" are used in this specification, they specify the presence of features, steps, operations, devices, components and/or combinations thereof.

Unless otherwise specified, the relative arrangement of components and steps, numerical expressions and numerical values set forth in these embodiments do not limit the scope of the present disclosure. At the same time, it should be appreciated that for the convenience of description, the dimensions of various parts shown in the drawings are not drawn according to the actual scale relationship. Techniques, methods and equipment known to those skilled in the art may not be discussed in detail, but in appropriate cases, they should be regarded as part of the authorization specification. In all the examples shown and discussed herein, any specific values should be interpreted as illustrative, and not as limiting. Therefore, other examples of exemplary embodiments may have different values. It should be noted that similar numbers and letters indicate similar items in the following drawings, therefore once an item is defined in one drawing, it does not need to be further discussed in subsequent drawings.

As shown in FIGS. 1 to 10, a quick-detachable and lockable infant bath seat includes a seat assembly 1. The front end and rear end of the seat assembly 1 are connected to a middle post 2 and a backrest seat 3 respectively, enhancing comfort for the child during use. The bottom of the seat assembly 1 is also connected with a plurality of positioning rings 26 to secure the seat assembly 1 to the ground, preventing the bath seat from moving during use. The top of the seat assembly 1 features an anti-slip pattern 27 to prevent the infant from slipping or bumping due to wet conditions. Additionally, the top of the seat assembly 1 is equipped with a first drainage hole to improve drainage efficiency of the seat assembly 1.

In practical implementation of the present disclosure, the top of the middle post 2 is fitted with an elliptical locking box 4, which is equipped with a temperature sensing meter 28 on its top to monitor the bathing temperature, allowing users to adjust the water temperature as needed. The top of the backrest seat 3 is rotatably connected to a limiting armrest 5. The elliptical locking box 4 has accommodating grooves 6 on both left and right ends, each containing a slidable locking block 7. For ease of locking, the outer wall of the locking block 7 is configured to be arc-shaped. When the limiting armrest 5 rotates, it presses against the locking block 7, thereby controlling the sliding of the limiting armrest 5. The outer wall of the free end of the limiting armrest 5 is recessed with a lock hole 8, while the inner end of the locking block 7 is fitted with a locking tongue 9 to be engaged with the lock hole 8. Once the limiting armrest 5 fully enters the accommodating groove 6, the locking tongue 9 and the lock hole 8 are engaged to secure the limiting armrest 5. Simultaneously, the left-right sliding locking blocks 7 prevent loosening of the limiting armrest 5 when not manually controlled. The elliptical locking box 4 also includes a limiting block 31 inside the accommodating groove 6, and the outer wall of the free end of the limiting armrest 5 is recessed with a limiting groove 32 that matches the limiting block 31. When the limiting block 31 engages with the limiting groove 32, the limiting armrest 5 is further locked to prevent further movement of the limiting armrest. It is understandable that the dual locking mechanism of the locking tongue 9 and limiting block 31 restricts the movement of the limiting armrest 5, enhancing the stability of the limiting armrest 5.

In an embodiment: the middle part of the elliptical locking box 4 is also fixed with a positioning frame 10. The central inner part of the locking block 7 is recessed with a positioning port 11. Both ends of the positioning frame 10 are provided with positioning tongues 12 that protrude outward to match the positioning port 11. The sidewall of the positioning port 11 has an inclined surface 13 to facilitate the insertion of the positioning tongue 12. The locking block 7 is positioned by the positioning tongue 12. When the positioning tongue 12 moves, it synchronously drives the locking block 7 to move, adjusting the position of the locking block 7. Additionally, the top and bottom of the locking block 7 protrude with sliding blocks 16, and the accommodating groove 6 is recessed with sliding grooves 17 to match the sliding blocks 16. The cooperation of the sliding grooves 17, the positioning port 11, and the positioning tongue 12 ensures stable sliding of the locking block 7, enabling the locking block 7 to move in a straight line.

To facilitate resetting during sliding, a reset spring is connected between the inner wall of the locking block 7 and the accommodating groove 6. The locking block 7 is recessed with a spring groove 14 to accommodate the reset spring, and a center post 15 is connected within the spring groove 14. By fitting the reset spring over the center post 15, the position of the locking block 7 is controlled, allowing it to automatically reset after being squeezed, thereby completing the locking operation.

It can be understood that during the locking process of the limiting armrest 5, only one hand is needed to push the limiting armrest 5 to move, while the other hand can hold the baby's body to prevent the baby from moving around and getting pinched by the limiting armrest 5, thereby improving the safety of the bathing chair.

Figure 4:
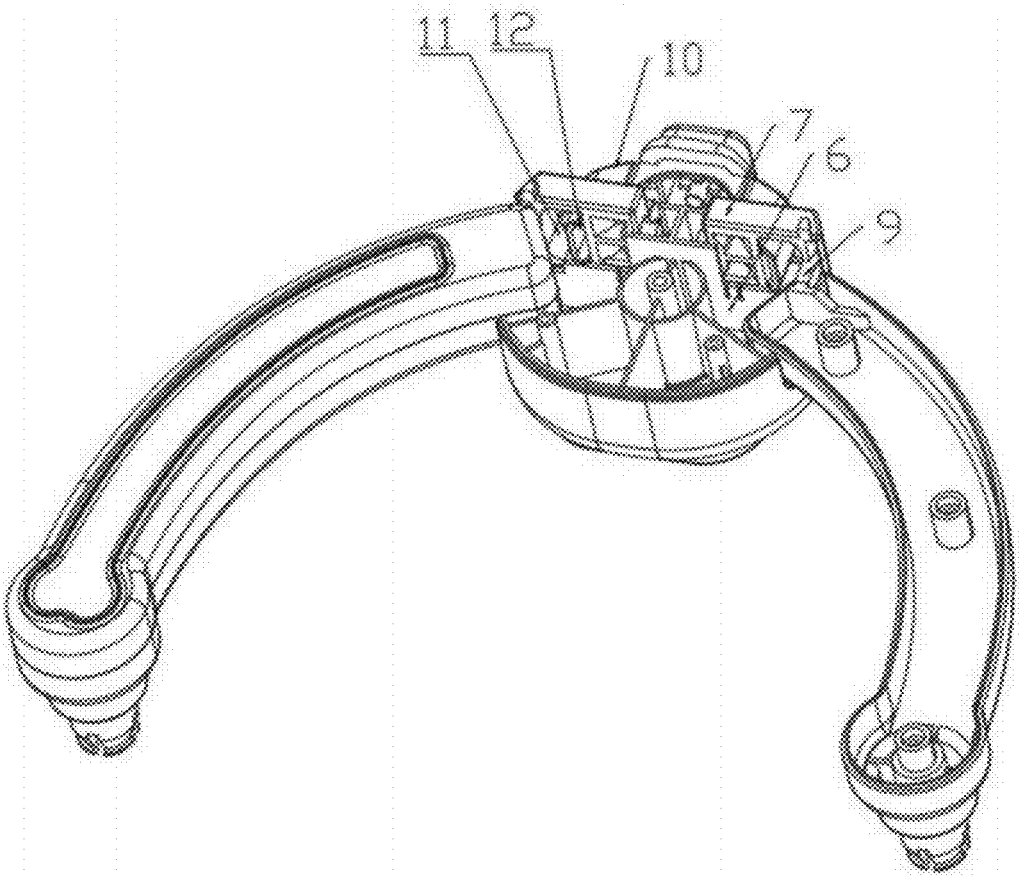
FIG. 4 is a schematic structural diagram of the connection between the elliptical locking box and the limiting armrest.
Figure 5:
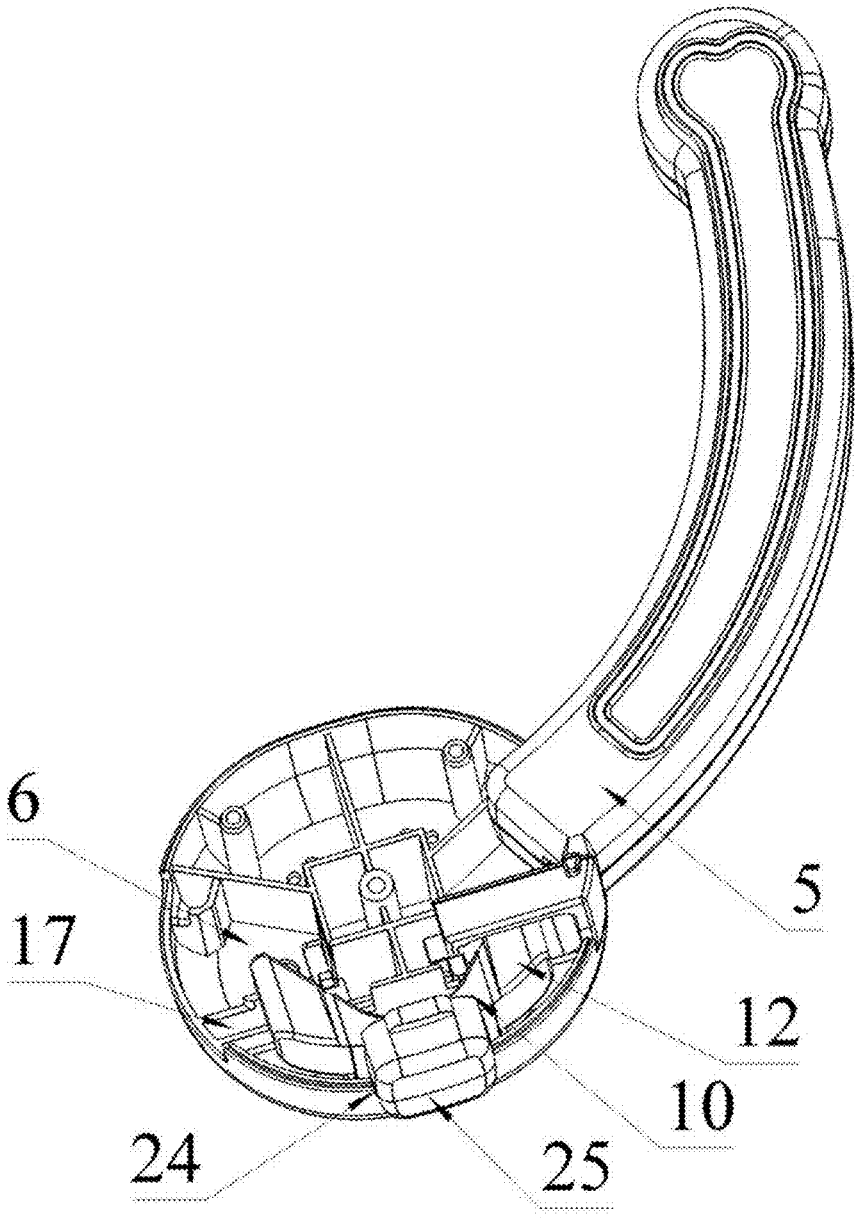
FIG. 5 is a schematic structural diagram of the elliptical locking box and limiting armrest from a second perspective.
Figure 6:
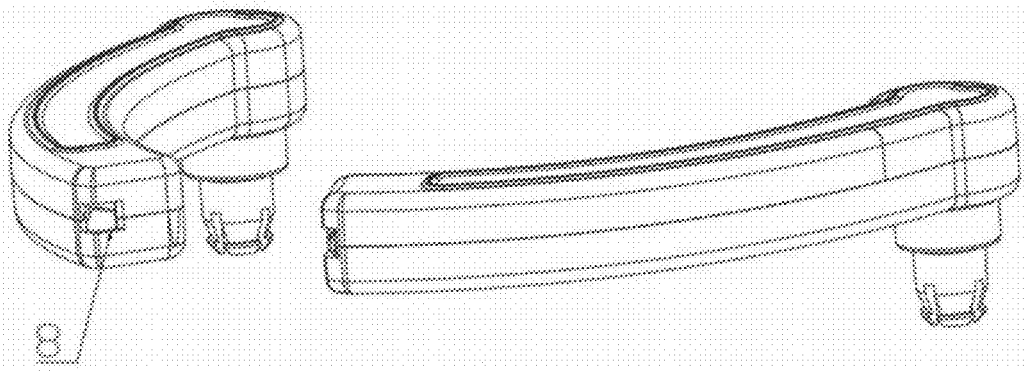
FIG. 6 is a schematic structural diagram of the limiting armrest.
Figure 7:
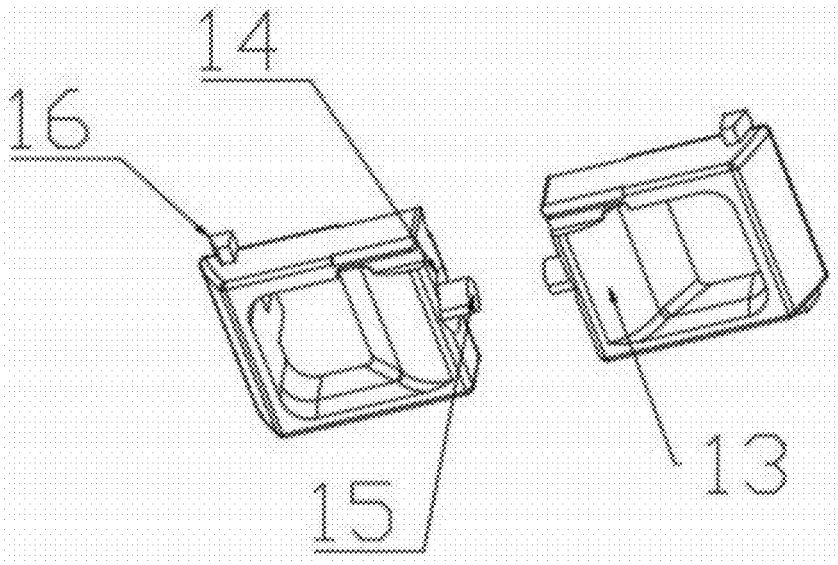
FIG. 7 is a schematic structural diagram of the locking block.

As shown in FIGS. 1, 4, and 5, in an implementation, the elliptical locking box 4 includes an upper housing 18 and a lower housing 19. Structures such as the accommodating groove 6 and the sliding groove 17 are recessed into the upper housing 18 and the lower housing 19, respectively, and their positions correspond. Additionally, to facilitate the fixation of the positioning frame 10, a groove opening 24 is recessed between the upper housing 18 and the lower housing 19. The outer end of the positioning frame 10 protrudes with a bump 25 that matches the groove opening 24. By pressing the bump 25, the positioning frame 10 and the positioning tongue 12 are driven to move together. The positioning tongue 12 pushes the locking block 7 to move via the inclined surface 13 and compresses the reset spring, unlocking the limiting armrest 5 from the locking block 7 and releasing the restriction on the limiting armrest 5, allowing the limiting armrest 5 to rotate.

Figure 3:
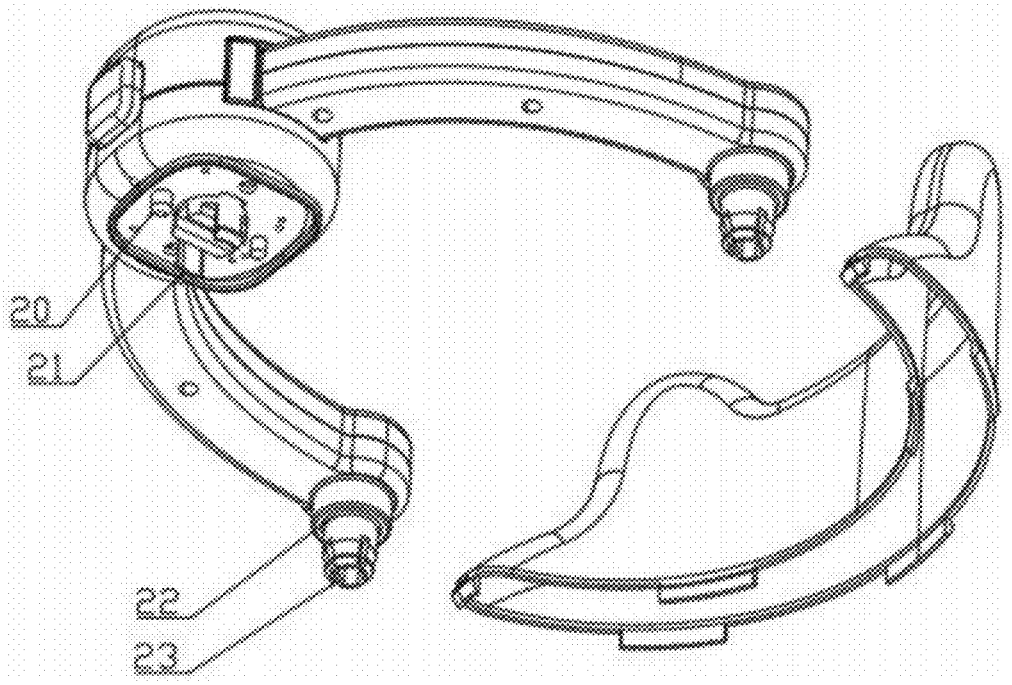
FIG. 3 is a schematic structural diagram of a bottom view of the armrest and elliptical locking box.

As shown in FIG. 3, the bottom end of the limiting armrest 5 is connected with a shaft body 22. The bottom end of the shaft body 22 is provided with several second elastic cards 23 along its circumferential direction, which are arranged in a conical configuration around the shaft body 22. The top of the backrest seat 3 is recessed with a shaft hole designed to accommodate the second elastic cards 23. The lower housing 19 has several positioning posts 20 and a first elastic card 21 protruding from its bottom end. The top of the middle post 2 is recessed with positioning sockets and a bayonet to match the positioning posts 20 and first elastic card 21. The snap-fit structure of the elastic cards facilitates the disassembly, maintenance, and operation of each structural component when not in use.

Figure 8:
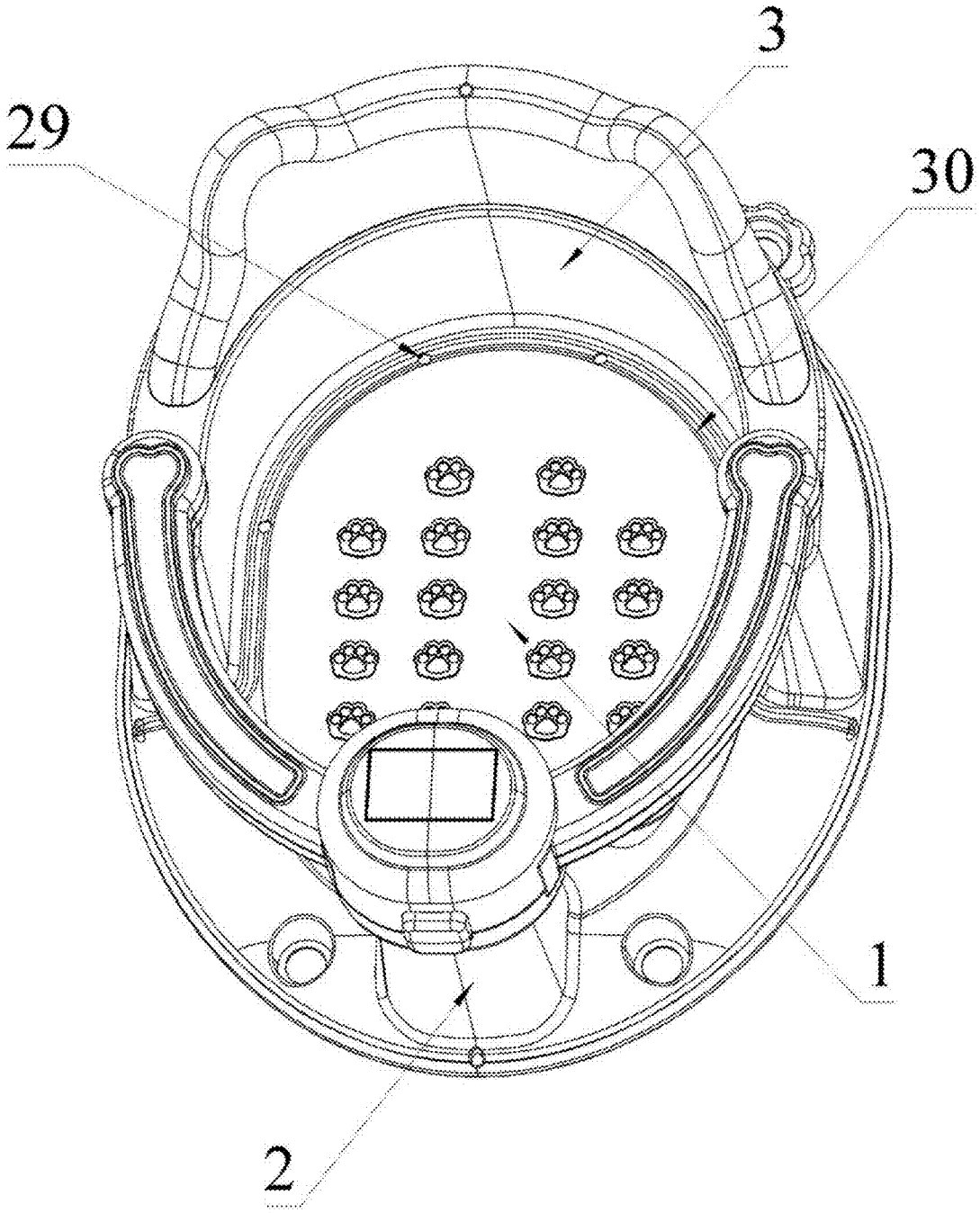
FIG. 8 is a schematic structural diagram of other embodiments in FIG. 1.
Figure 9:
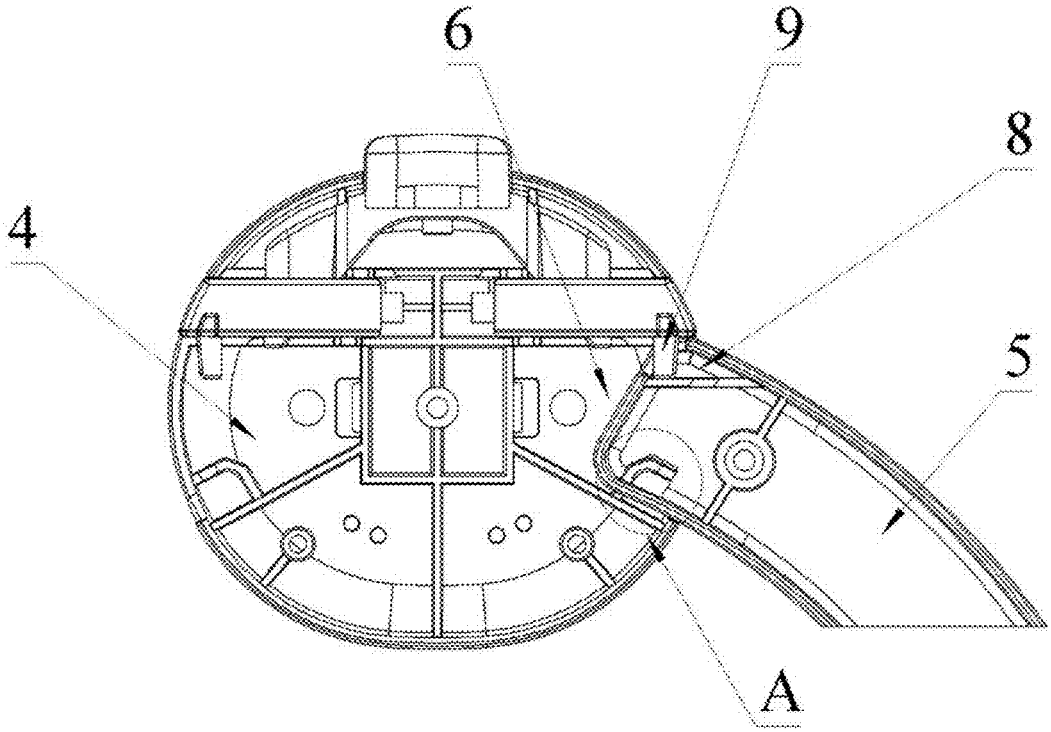
FIG. 9 is a top view of the elliptical locking box and limiting armrest in FIG. 4.
Figure 10:
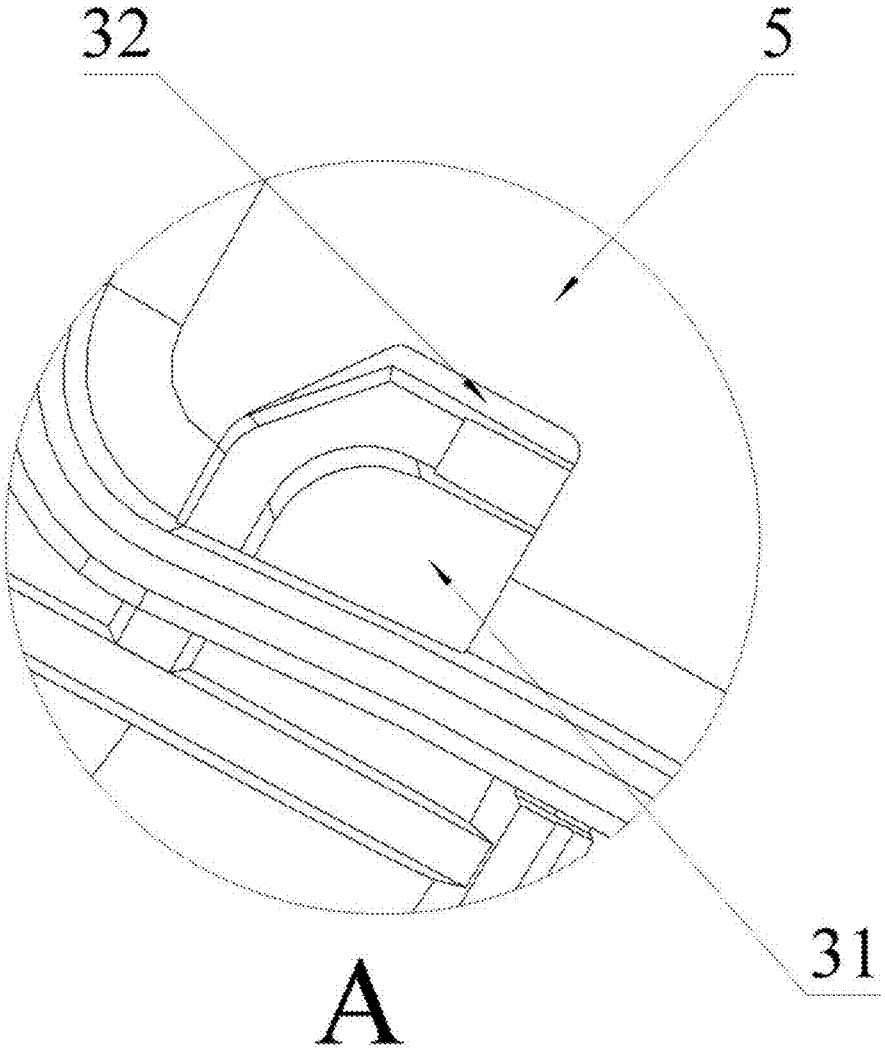
FIG. 10 is an enlarged schematic structural diagram of section A in FIG. 9.

In other embodiments (as shown in FIG. 8), the first drainage hole is omitted, and a U-shaped drainage groove 30 is opened at the top of the seat assembly 1. The drainage groove 30 corresponds to the inner wall shape of the backrest seat 3 and is equipped with a plurality of evenly spaced secondary drainage holes 29. Through the cooperation of the drainage groove 30 and the secondary drainage holes 29, water generated during showering is quickly drained. In other embodiments (not shown in the drawings), addressing scenarios of summer heat and diverse bathroom floor materials (tiles/anti-slip mats/wooden floors): the seat assembly 1 adopts a food-grade PP+breathable mesh openwork stitching structure, with the mesh area covering the infant's buttock and back contact positions. The positioning ring 26 at the base of the seat assembly 1 is upgraded to a "replaceable silicone pad+threaded adjustment post" combination—the silicone pad is detachably connected to the positioning ring 26 via clips, available in three specifications: smooth (for tiles), granular anti-slip (for wooden floors), and thin (for bathroom anti-slip mats). The threaded adjustment post allows fine tuning of the positioning ring 26 height by rotation, resolving inclination issues caused by uneven floors. The temperature sensing meter 28 atop the elliptical locking box 4 is replaced with an "electronic digital temperature sensor+sound-light alarm module," with the sensor probe extending to the seat assembly 1's water channel area (the seat assembly 1 is recessed with a shallow water channel to prevent infants from contacting cold water). When the water temperature is >40° C. or <35° C., the alarm module triggers a buzzing alert. Meanwhile, the anti-slip pattern 27 at the top of the seat assembly 1 is upgraded to "zoned bulges," with a pattern interval of 3 mm in the buttock area (enhanced anti-slip property) and a pattern interval of 5 mm in the leg support area (reduced indentation). At the shaft body 22 of the backrest seat 3 and the limiting armrest 5, an "annular pull ring" is added outside the second elastic card 23, allowing disassembly to be achieved by simply pulling the ring to contract the second elastic card 23 without tools. The connection between the middle post 2 and the elliptical locking box 4, besides the positioning post 20+first elastic card 21, includes an additional "rotational positioning pin." After inserting the positioning post 20 into the positioning socket during installation, the positioning pin is rotated to achieve locking, preventing loosening of the elastic cards after prolonged use. This bath seat is adaptable to various bathroom floors, more breathable for summer use, has more precise water temperature alerts, and can be assembled and disassembled without tools, which is suitable for single-hand operation by new parents.

In other embodiments (not shown in the drawings), this embodiment focuses on "home storage+portability" needs, adding folding and storage structures to the core functionality, which is specifically as follows: the connections between the seat assembly 1, the middle post 2 and the backrest seat 3 all employ "damping hinges+clip locks": pressing the unlock buttons on both sides of the middle post 2 allows folding the seat assembly 1 toward the middle post 2 (folded thickness reduced from 15 cm to 5 cm); the hinge connecting the backrest seat 3 and the seat assembly 1 features 3 positions (90° upright/110° reclined/135° lying), accommodating the sitting/semi-reclining needs of infants aged 0-18 months. The limiting armrest 5 is designed as a "three-stage telescopic structure": including a fixed segment (connected to the shaft body 22), a middle telescopic segment, and a free end (engaged with the elliptical locking box 4). The elastic button on the telescopic segment is pressed to adjust the length, and during folding, the free end can be retracted into the fixed segment to reduce storage volume. Storage and auxiliary functions: The middle post 2 is a hollow structure, with a "flip-top storage compartment" on the outer side, which is divided into 2 small sections (for placing baby shampoo or sponge scrubs). The compartment lid is made of transparent PP material for easy viewing of contents. The upper housing 18 of the elliptical locking box 4 is additionally equipped with a "magnetic hook" on the outer side, allowing for hanging baby towels or bath balls; the temperature sensing meter 28 is magnetically installed and can be detached for standalone use as a bathroom thermometer. The positioning ring 26 is replaced with a "foldable suction cup," which can be folded inward when not in use (to avoid bumps) and unfolded and pressed to adhere to smooth surfaces during use. The inner wall of the lock hole 8 in the limiting armrest 5 is fitted with a "silicone gasket," which increases friction when the locking tongue 9 is inserted, preventing slippage caused by water seepage during bathing. When folded, the compact size allows it to fit into a diaper bag for portability. Integrated storage reduces bathroom clutter, while the magnetic design enhances accessory reusability, making it suitable for rental homes or scenarios involving frequent outings with infants.

In other embodiments (not shown), this embodiment addresses the needs of "changes in body size during infant growth" and "anti-misoperation unlocking" with adjustable and safety upgrades, as follows: the seat assembly 1 features a "front-back sliding" seat panel design: the bottom of the seat panel is equipped with two parallel sliding rails, each with three positioning holes, and by inserting positioning pins, the front-back position of the seat panel can be adjusted (adjustment range: 0-8 cm), accommodating infants aged 0-6 months (smaller size) and 6-18 months (larger size). The height of the limiting armrest 5 is adjustable: the shaft body 22 adopts a segmented sleeve structure with external scale markings and an elastic buckle. The armrest can be pulled to adjust its height (adjustment range: 15-22 cm), preventing shoulder pressure when the infant grows taller. The elliptical locking box 4 incorporates an added "electronic locking module": in addition to the original mechanical lock (locking tongue 9+lock hole 8), the locking block 7 is topped with a miniature electromagnetic lock. When the locking tongue 9 is inserted into the lock hole 8, the electromagnetic lock automatically powers on to secure the locking block 7. Unlocking requires pressing the bump 25 on the positioning frame 10 (to release the mechanical lock) followed by pressing the unlock button on the side of the seat assembly 1 (to cut power to the electromagnetic lock), ensuring dual-operation to prevent accidental unlocking by the infant. The backrest seat 3 includes an added "safety belt hook" on its inner side: equipped with an adjustable three-point safety belt (made of skin-friendly nylon), the belt's ends being connected to the backrest seat 3 via hooks, further securing the infant's body and preventing rolling during bathing. The edges of the seat assembly 1 and the outer side of the limiting armrest 5 are wrapped with 1 cm-thick soft silicone strips (a hardness of 50 ShoreA) to prevent infant bumps. The bottom of the positioning ring 26 features "drainage holes" to avoid bacterial growth from water accumulation post-bathing. Adjustable sizing for infant age, dual-locking for enhanced safety, soft wrapping, and drainage design improve user experience, making it ideal for families prioritizing long-term use and safety.

In summary, the present disclosure achieves the following technical effects:

Rotate the limiting armrest 5 to allow its free end to enter the accommodating groove 6 of the elliptical locking box 4. The outer wall of the limiting armrest 5 presses against the outer end wall of the locking block 7, pushing the locking block 7 to slide along the sliding groove 17, thereby compressing the return spring. When the limiting armrest 5 fully enters the accommodating groove 6, the locking tongue 9 inserts into the lock hole 8 under the force of the return spring, completing the locking. Press the bump 25 of the positioning frame 10 to move the positioning tongue 12, which then pushes the locking block 7 to slide via the inclined surface 13, compressing the return spring and causing the locking tongue 9 to disengage from the lock hole 8, thereby unlocking the limiting armrest 5, which can then be rotated.

In the description of the present disclosure, it should be appreciated that directional terms such as "front, rear, up, down, left, right", "horizontal, vertical, perpendicular, horizontal" and "top, bottom" etc. indicate the orientation or positional relationship based on the orientation or positional relationship shown in the drawings, and are only for the convenience of describing the present disclosure and simplifying the description. In the absence of a contrary explanation, these directional terms do not indicate or imply that the device or element referred to must have a specific orientation or be constructed and operated in a specific orientation, and therefore should not be understood as limiting the scope of protection of the present disclosure; the directional terms "inside, outside" refer to the inside and outside relative to the contour of each component itself.

For the convenience of description, spatial relative terms such as "on . . . ", "above . . . ", "on the upper surface of . . . ", "upper" etc. may be used here to describe the spatial positional relationship of a device or feature with other devices or features as shown in the drawings. It should be appreciated that spatial relative terms are intended to encompass different orientations of the device in use or operation other than the orientation described in the drawings. For example, if the device in the drawing is inverted, the device described as "above other devices or structures" or "on other devices or structures" will subsequently be positioned as "below other devices or structures" or "under other devices or structures". Thus, the exemplary term "above" can include both "above" and "below" orientations. The device can also be positioned in other different ways (rotated 90 degrees or in other orientations), and the spatial relative descriptions used here should be interpreted accordingly.

In addition, it should be noted that the use of terms such as "first", "second" etc. to define components is for the convenience of distinguishing the corresponding components. Unless otherwise stated, the above terms have no special meaning, and therefore should not be understood as limiting the scope of protection of the present disclosure.

The above description is only a preferred embodiment of the present disclosure and is not intended to limit the present disclosure. For those skilled in the art, the present disclosure can have various modifications and changes. Any modifications, equivalent replacements, improvements etc. made within the spirit and principles of the present disclosure should be included within the scope of protection of the present disclosure.

What is claimed is:

1. A quick-detachable and lockable infant bath seat, comprising a seat assembly, with a middle post and a backrest seat connected to a front end and a rear end of the seat assembly respectively, wherein an elliptical locking box is mounted at a top of the middle post, and a limiting armrest is rotatably connected to a top of the backrest seat; and a temperature sensing meter is snapped onto a top of the elliptical locking box, a first accommodating groove is provided on a right end of the elliptical locking box, and a second accommodating groove is provided on a left end of the elliptical locking box, wherein a respective slidable locking block is arranged within each of said accommodating grooves, and each of the locking blocks has an arc-shaped outer end wall; and a lock hole is recessed on an outer side wall of a free end of the limiting armrest, and a locking tongue is provided at an inner end of a locking block of said locking blocks to be engaged with the lock hole.

2. The quick-detachable and lockable infant bath seat according to claim 1, wherein a positioning frame is further fixed at a middle portion of the elliptical locking box, a respective positioning port is recessed at a middle portion of each of the locking blocks, a respective positioning tongue protrudes from each of two ends of the positioning frame, wherein each of the respective positing tongues is configured to be engaged with a respective positioning port of said position ports, and a side wall of each of the positioning ports is provided with an inclined surface to facilitate the insertion of the respective positioning tongues.

3. The quick-detachable and lockable infant bath seat according to claim 2, wherein a return spring is connected between an inner wall of the locking block and the first accommodating groove, a spring groove is recessed in the locking block to accommodate the return spring, and a center post is connected within the spring groove; and sliding blocks protrude from a top and a bottom of the locking block, and sliding grooves are recessed in the first accommodating groove to be engaged with the sliding blocks.

4. The quick-detachable and lockable infant bath seat according to claim 3, wherein the elliptical locking box comprises an upper housing and a lower housing; several positioning posts and a first elastic card protrude from a bottom end of the lower housing, and positioning sockets and a bayonet are recessed at the top of the middle post to be engaged with the several positioning posts and the first elastic card; and a shaft body is connected to a bottom end of the limiting armrest, and several second elastic cards are arranged along a circumferential direction of the shaft body at a bottom end thereof, wherein the several second elastic cards are tapered along the circumferential direction of the shaft body, and a shaft hole is recessed at the top of the backrest seat to be engaged with the several second elastic cards.

5. The quick-detachable and lockable infant bath seat according to claim 4, wherein a groove opening is concavely provided between the upper housing and the lower housing, and an outer end of the positioning frame protrudes to form a bump to be engaged with the groove opening.

6. The quick-detachable and lockable infant bath seat according to claim 1, wherein a bottom end of the seat assembly is further connected with a plurality of sets of positioning rings, and a top end of the seat assembly is provided with an anti-slip pattern.

7. A quick-detachable and lockable infant bath seat, comprising:

a seat assembly, wherein a backrest seat is provided at a rear end of the seat assembly, and a middle post is provided at a front section of the seat assembly; and an elliptical locking box arranged on the middle post; and a limiting armrest rotatably connected to the backrest seat, wherein a free end of the limiting armrest is configured to be receivable by the elliptical locking box; and a first accommodating groove is provided on a first side of the elliptical locking box, and a second accommodating groove is provided on a second side of the elliptical locking box, each of the accommodating grooves housing a respective locking block slidable along a straight line; and a lock hole formed on an outer sidewall of the free end of the limiting armrest;

wherein an inner end of a locking block of the locking blocks is provided with a locking tongue for engaging with the lock hole to achieve locking;

a reset elastic member arranged between the locking block and an inner wall of the first accommodating groove, providing the locking block with an elastic force that tends to insert the locking tongue into the lock hole; and an unlocking mechanism arranged on the elliptical locking box and engaging with the locking block, configured to drive the locking block to slide against the elastic force of the reset elastic member, thereby disengaging the locking tongue from the lock hole.

8. The quick-detachable and lockable infant bath seat according to claim 7, wherein the unlocking mechanism comprises a positioning frame fixedly arranged at a middle portion of the elliptical locking box; a middle portion of the locking block is recessed to form a positioning port; an end of the positioning frame is provided with a positioning tongue extending into the positioning port; the positioning frame is operable to drive the positioning tongue to push against a sidewall of the positioning port, thereby driving the locking block to slide.

9. The quick-detachable and lockable infant bath seat according to claim 8, wherein the sidewall of the positioning port is provided with an inclined surface; the positioning tongue pushes the locking block to slide by acting on the inclined surface.

10. The quick-detachable and lockable infant bath seat according to claim 8, wherein both ends of the positioning frame are provided with positioning tongues that are engaged with positioning ports on the respective locking blocks, enabling the operation of the positioning frame to synchronously drive the two locking blocks to move apart or toward each other.

11. The quick-detachable and lockable infant bath seat according to claim 8, wherein the elliptical locking box comprises an upper housing and a lower housing that are detachably connected, and the positioning frame is accommodated within a space enclosed by the upper housing and the lower housing.

12. The quick-detachable and lockable infant bath seat according to claim 11, wherein the positioning frame is provided with an outwardly protruding operating part, the upper housing or the lower housing is provided with a groove opening for exposing the operating part, and the operating part is a bump.

13. The quick-detachable and lockable infant bath seat according to claim 7, wherein the reset elastic member is a reset spring, the locking block is recessed with a spring groove, and the reset spring is arranged within the spring groove.

14. The quick-detachable and lockable infant bath seat according to claim 7, wherein a top and a bottom of the locking block protrude with sliding blocks, the first accommodating groove is recessed with sliding grooves adapted to the sliding blocks, and engagement between the sliding blocks and the sliding grooves guides linear sliding of the locking block.

15. The quick-detachable and lockable infant bath seat according to claim 7, wherein the limiting armrest is rotatably connected to the backrest seat through a quick disassembly and assembly structure; the quick disassembly and assembly structure comprises a shaft body arranged at a bottom end of the limiting armrest and several elastic cards arranged along a circumferential direction of the shaft body, and a top of the backrest seat is provided with shaft holes to be engaged with the several elastic cards.

16. The quick-detachable and lockable infant bath seat according to claim 7, wherein a top of the elliptical locking box is provided with a temperature sensing meter.

17. The quick-detachable and lockable infant bath seat according to claim 7, wherein a bottom end of the seat assembly is connected with a positioning ring for fixing the seat assembly to the ground, and a top surface of the seat assembly is provided with an anti-slip pattern.

18. A quick-detachable and lockable infant bath seat, comprising:

a seat assembly provided with a backrest seat and a middle post; and a locking seat arranged on the middle post, having an accommodating space inside, wherein the locking seat is an elliptical locking box, the accommodating space is accommodating grooves, and each of the accommodating grooves is arranged a respective side of the elliptical locking box; and a limiting armrest, with one end rotatably connected to the backrest seat, another end being a free end capable of entering the accommodating space; and a locking component arranged within the locking seat, movable along a preset trajectory; and a complementary locking structure, comprising a locking part arranged on the locking component and a locked part arranged on the free end of the limiting armrest, wherein the locking part and the locked part can be engaged to achieve locking; and a bias device arranged between the locking seat and the locking component, providing the locking component with a bias force that tends to engage the locking part with the locked part; and an unlocking assembly engaged with the locking component, capable of driving the locking component to move against the force of the bias device to disengage the locking part from the locked part to release locking.

19. The quick-detachable and lockable infant bath seat according to claim 18, wherein the locking component is a locking block, the locking part is a locking tongue, the locked part is a lock hole, and the locking tongue and lock hole can be engaged to achieve the locking of the limiting armrest; the bias device is a return spring configured to provide the locking block with a bias force that tends to engage the locking tongue with the lock hole.

* * * * *